US010788186B2

(12) United States Patent
Estes et al.

(10) Patent No.: US 10,788,186 B2
(45) Date of Patent: Sep. 29, 2020

(54) ILLUMINATION WITH BLUE UV LIGHT SOURCE AND VISIBLE LIGHT SOURCE

(71) Applicant: Sensor Electronic Technology, Inc., Columbia, SC (US)

(72) Inventors: Faris Mills Morrison Estes, West Columbia, SC (US); Alexander Dobrinsky, Silver Spring, MD (US); Maxim S. Shatalov, Columbia, SC (US)

(73) Assignee: Sensor Electronic Technology, Inc., Columbia, SC (US)

( * ) Notice: Subject to any disclaimer, the term of this patent is extended or adjusted under 35 U.S.C. 154(b) by 120 days.

(21) Appl. No.: 16/205,960

(22) Filed: Nov. 30, 2018

(65) Prior Publication Data

US 2019/0162381 A1 May 30, 2019

Related U.S. Application Data

(60) Provisional application No. 62/592,591, filed on Nov. 30, 2017.

(51) Int. Cl.
*F21V 21/00* (2006.01)
*F21S 41/64* (2018.01)
(Continued)

(52) U.S. Cl.
CPC ..... *F21S 41/645* (2018.01); *F21S 41/17* (2018.01); *F21S 41/37* (2018.01); *F21S 41/43* (2018.01);
(Continued)

(58) Field of Classification Search
CPC ..... F21S 41/645; F21S 41/37; F21S 41/17; F21S 41/43; F21V 5/04; F21V 7/0091;
(Continued)

(56) References Cited

U.S. PATENT DOCUMENTS 4,970,628 A 11/1990 Bergkvist
5,255,163 A 10/1993 Neumann
(Continued)

FOREIGN PATENT DOCUMENTS

WO 2015060546 A1 4/2015
WO 2017097762 A1 6/2017
WO 2019108910 A1 6/2019

OTHER PUBLICATIONS

International Application No. PCT/US2018/063274, International Search Report and Written Opinion, dated Mar. 22, 2019, 12 pages.

*Primary Examiner* — Laura K Tso
(74) *Attorney, Agent, or Firm* — LaBatt, LLC

(57) ABSTRACT

An approach for providing illumination with a blue UV light source, which can be used in combination with a visible light source is disclosed. In operation, the visible light source emits visible light at a first intensity. The blue UV light source emits blue UV light at a second intensity. The blue UV light stimulates fluorescence from a surface of an object illuminated by the blue UV light. A sensor can detect the intensity of the fluorescence from the surface illuminated by the blue UV light source. A control module can be operatively coupled to the visible light source, the blue UV light source, and the at least one sensor, and be configured to change the intensity of the visible light and/or the intensity of the blue UV light as a function of the fluorescent intensity detected by the sensor.

20 Claims, 7 Drawing Sheets

(51) Int. Cl.

| | |
|---|---|
| ***F21S 41/43*** | (2018.01) |
| ***F21S 41/17*** | (2018.01) |
| ***F21V 9/06*** | (2018.01) |
| ***F21S 41/37*** | (2018.01) |
| ***F21V 5/04*** | (2006.01) |
| ***F21V 7/00*** | (2006.01) |
| ***F21V 23/04*** | (2006.01) |
| *F21Y 115/30* | (2016.01) |
| *F21Y 113/13* | (2016.01) |

(52) U.S. Cl.
CPC ..... *F21V 5/04* (2013.01); *F21V 7/0091* (2013.01); *F21V 9/06* (2013.01); *F21V 23/0442* (2013.01); *F21Y 2113/13* (2016.08); *F21Y 2115/30* (2016.08)

(58) Field of Classification Search
CPC .... F21V 9/06; F21V 23/0442; F21Y 2115/30; F21Y 2113/13
USPC ..... 362/37–60, 459–549
See application file for complete search history.

(56) References Cited

U.S. PATENT DOCUMENTS

| | | | | |
|---|---|---|---|---|
| 5,448,461 | A | 9/1995 | Fast et al. | |
| 10,076,993 | B2 | 9/2018 | Nichols | |
| 2004/0105264 | A1 | 6/2004 | Spero | |
| 2012/0020102 | A1* | 1/2012 | Lambert | B60K 35/00 362/503 |
| 2013/0154519 | A1 | 6/2013 | Riesebosch | |
| 2013/0158774 | A1* | 6/2013 | Schmidt | B62D 15/0285 701/25 |
| 2014/0365063 | A1 | 12/2014 | Troy et al. | |
| 2015/0291086 | A1* | 10/2015 | Salter | B60Q 3/30 362/485 |
| 2018/0032827 | A1 | 2/2018 | Boutet et al. | |
| 2018/0363858 | A1* | 12/2018 | Peeters | G02B 6/00 |

* cited by examiner

ILLUMINATION WITH BLUE UV LIGHT SOURCE AND VISIBLE LIGHT SOURCE

REFERENCE TO RELATED APPLICATIONS

The present patent application claims the benefit of U.S. Provisional Application No. 62/592,591, filed on 30 Nov. 2017, which is incorporated herein by reference in its entirety.

TECHNICAL FIELD

The disclosure relates generally to illumination systems, and more particularly, to illumination systems that utilize blue UV light (e.g., UV-A light) with visible light (e.g., white light) to improve the illumination of objects.

BACKGROUND ART

A vehicle lighting system such as the vehicle headlamps system is one example of an illumination system where it is generally always desirable to have improved illumination of objects that one may encounter especially during nighttime driving. The visibility distance that one may have while driving during the night depends upon the availability of artificial light, namely vehicle headlamps and fixed overhead lighting. By and large, the main source of illumination available to the driver of a vehicle is the headlamps. The condition and potency of these lamps will directly impact the driver's ability to see objects and pedestrians at night. It has been found that the low beams of a vehicle headlamp system typically do not provide adequate visibility under many driving conditions. This makes it hard to see objects and pedestrians in or near the road, including for example, signs, markings, or other devices used to guide motorists while traveling in their vehicle during nighttime.

SUMMARY OF THE INVENTION

This Summary Of The Invention introduces a selection of certain concepts in a brief form that are further described below in the Detailed Description Of The Invention. It is not intended to exclusively identify key features or essential features of the claimed subject matter set forth in the Claims, nor is it intended as an aid in determining the scope of the claimed subject matter.

Aspects of the present invention are directed to illumination systems that utilize blue ultraviolet light, which includes light having wavelengths in a range including UV-A light and high frequency visible light, to improve the illumination of objects through fluorescence, which can be used in combination with visible light. The illumination systems of the various embodiments are well suited for use with vehicles, and in particular, vehicle lighting systems such as vehicle headlamp systems. Use of the illumination systems of any of the embodiments in a vehicle headlamp system can enhance nighttime visibility of objects and pedestrians in or near a road, making nighttime driving significantly safer for motorists in comparison to a headlamp system that relies only on low beams and high beams generating visible light to provide illumination.

The use of UV light, such as blue UV or UV-A light, in combination with visible light, such as white light, enables the illumination systems of the various embodiments to enhance the visibility of objects having fluorescent materials which can include, but are not limited to, road signs, road markings, and other devices used to guide motorists, as well as protective clothing that may be worn by emergency personnel, highway crews, vehicle roadside assistance workers, and police and/or markings deployed on their corresponding vehicles. In particular, blue UV light with an emission spectra between 340 nm and 460 nm, has a shorter minimum wavelength than light normally used for illumination (e.g., white light) and may be invisible to the human eye. However, when blue UV light is reflected in certain materials, it is returned on longer wavelengths and becomes more readily visible. This phenomenon, known as fluorescence, makes objects more visible and thus offers a large potential for improving safety.

Therefore, the use of UV-A light and/or blue UV light with visible light enables the illumination systems of the various embodiments to highlight anything in or near the road that contains fluorescent materials. This increases the visibility distance that objects with these materials can be typically seen in comparison with low beam and even high beams while not generating significant glare that can blind oncoming traffic and/or people wearing articles with fluorescent materials. The supplementation of visible light with blue UV and/or UV-A light in the various embodiments can also increase the visibility of other objects that may not be equipped with fluorescent material specifically deployed to increase visibility as generally most materials have some level of fluorescence.

Each of the illumination systems of the various embodiments described herein can utilize a visible light source to emit visible light at a first intensity. The visible light source can include a visible light emitting source that emits radiation having a wavelength at least partially in a range of 400 nm to 700 nm. In an embodiment, the visible light is configured to be perceived as white light (e.g., light with wavelengths across the visible spectrum, light including multiple distinct wavelength peaks in the visible spectrum that are perceived as white when mixed, etc.). Examples of a visible light emitting source can include, but are not limited to, a visible light emitting diode (LED), an incandescent light, a fluorescent light, a laser, a solid-state light source, a filament bulb, a xenon bulb, and/or the like. In one embodiment, the visible light source can include a set of visible light sources configured to emit a set of visible light beams. Each of the visible light sources in the set or the individual visible light sources in illumination systems that utilize only one visible light source, can be configured to have yaw and pitch with several degrees of freedom. In this manner, a vehicle headlamp system that incorporates one of the illumination systems described herein can provide a larger aerial illumination about the vehicle at each yaw and pitch degree than what is typically provided with a conventional system that deploys low beams, high beams and other light modalities used with a vehicle such as front fog lights, position lights, daytime running lights, direction indicators, side marking lights, spot lights, brake lights and hazard lights.

A blue UV and/or UV-A light source (also referred as a blue UV light source) can supplement the visible light source by emitting blue UV and/or UV-A light (also referred as a blue UV light) at a second intensity. In operation, the blue UV light stimulates fluorescence from at least one surface of an object illuminated by the blue UV light. The blue UV light source can include a blue UV light emitting source that emits radiation having a wavelength at least partially in a range of 340 nm to 460 nm. In one embodiment, the blue UV light emitted from the blue UV light source can vary with time. An ultraviolet radiation emitter can be used as a blue UV light emitting source to emit blue UV light. Examples of an ultraviolet radiation emitter can include, but are not limited to, high intensity ultraviolet lamps (e.g., high intensity mercury lamps), discharge lamps, UV LEDs, super luminescent LEDs, lasers, laser diodes, and/or the like. The blue UV light source can also include a set of LEDs manufactured with one or more layers of materials selected from the group-III nitride material system (e.g., $Al_xIn_yGa_{1-x-y}N$, where $0 \leq x$, $y \leq 1$, and $x+y \leq 1$ and/or alloys thereof).

In one embodiment, the blue UV light source can include a set of blue UV light sources operating at a set of peak wavelengths. Each of the blue UV light sources within the set of blue UV light sources can be configured to operate at a different peak wavelength. The blue UV light sources within the set of blue UV light sources can differ by at least one of intensity, an intensity distribution pattern, a spectral power distribution or size. Like the set of visible light sources, the set of blue UV light sources can be configured with several yaw and pitch degrees of freedom. Similarly, illumination systems that deploy only one blue UV light source can be configured to have yaw and pitch with several degrees of freedom.

The visible light source(s) and the blue UV light source(s) can be housed within an optical element. To this extent, the optical element can control a direction that the visible light is emitted from the visible light source(s) and a direction that the blue UV light is emitted from the blue UV light source(s). In particular, the optical element collects as much as possible of the luminous flux (quantity of light) emitted by the visible light source(s) and the blue UV light source(s) to shape the respective beams of light and to direct it to where it is needed. For example, a vehicle headlamp system that incorporates one of the illumination systems of the various embodiments that utilizes the optical element can ensure that the beams of light are directed to road-space areas in a manner that is within the bounds defined by legal regulations. In one embodiment, the optical element can include a total internal reflection (TIR) lens having UV transparent media. The UV transparent media can include at least one of $SiO_2$, $CaF_2$, $MgF_2$, or a fluoropolymer.

The visible light source(s) and the blue UV light source(s) can operate cooperatively with each other to generate beams of visible light and blue UV light, respectively, with different combinable features. For example, the visible light source(s) can generate a focused beam of visible light having a first angular distribution and the blue UV light source(s) can generate a diffuse beam of blue UV light having a second angular distribution. The first angular distribution can differ from the second angular distribution so that the angle of illumination of each beam differs, enabling the visible light source(s) to generate the focused beam and the blue UV light source(s) to generate the diffuse beam. In one embodiment, the visible light source(s) can generate a set of beams of visible light and the blue UV light source(s) can generate a set of beams of blue UV light, wherein the set of beams of visible light and the set of beams of blue UV light are non-collinear. In one scenario, at least one beam of visible light from the set of beams of visible light can differ in direction from at least one beam of blue UV light from the set of beams of blue UV light by at least five degrees as measured from a beam peak intensity point. In one embodiment, the visible light source(s) and the blue UV light source(s) can operate simultaneously such that each source emits light concurrently. In one embodiment, the intensity of visible light emitted from the visible light source(s) at a target location can be comparable to the blue UV light emitted from the blue UV light source(s) at that target location.

At least one sensor can be operatively coupled to the visible light source(s) and the blue UV light source(s) in order to obtain operational data relating to the illumination that is provided by the sources. For example, a sensor such as a fluorescent sensor can be used to detect a fluorescent signal intensity of the fluorescence from at least one surface of an object illuminated by the blue UV light source(s). In one embodiment, a reflective sensor such as a visible light sensor can be used to detect visible light reflected from at least one surface of an object illuminated by the visible light source(s). In one embodiment, a plurality of environmental sensors can be used to detect one of a plurality of environmental conditions in which the visible light source(s) and the blue UV light source(s) operate. Examples of environmental conditions that can be detected include, but are not limited to, humidity, temperature, clarity of air, a presence of fog, and a presence of air pollutants.

A control module can be operatively coupled to the visible light source(s), the blue UV light source(s), and the at least one sensor in order to manage an operation of the visible light source(s), the blue UV light source(s), and the at least one sensor. Managing the operation of these components can entail a number of different control configurations. For example, in a scenario which a fluorescent sensor is deployed to measure fluorescence, the control module can change the intensity of the visible light emitted from the visible light source(s) and/or the intensity of the blue UV light emitted from the blue UV light source(s) as a function of the fluorescent signal intensity detected by the fluorescent sensor. In one embodiment, the control module can change at least one of the intensity, direction or beam distribution of the visible light source(s) and the blue UV light source(s) based on feedback obtained from the fluorescent sensor. In a scenario in which environmental sensors are deployed, the control module can be used to adjust the intensity of the blue UV light from the blue UV light source(s) as a function of the environmental conditions detected by the plurality of environmental sensors. The control module can also direct the blue UV light source(s) to emit the blue UV light with one of a predetermined pattern or a predetermined spectral distribution based on the environmental conditions. The control module can adjust the intensity of the light as a function of at least one of the operating parameters associated with the visible light source(s) and the blue UV light source(s) during illumination of the sources.

In one embodiment, the control module can evaluate an optimality of illumination provided by the visible light source(s) and the blue UV light source(s) as a function of the detected fluorescence (e.g., the fluorescent signal intensity). In a related operation, the control module can optimize the illumination of at least one surface of an object with the blue UV light source(s) as a function of the detected fluorescent intensity. For example, the control module can determine a suitable peak wavelength for operating the blue UV light source(s) by taking into account power constraints (e.g., heat output and current threshold) of operating the blue UV light source(s). In one embodiment, the control module can obtain a plurality of fluorescent signal intensity measurements from the at least one surface of the object over a set of peak wavelengths, compare each of the fluorescent signal intensity measurements, ascertain an appropriate fluorescent signal intensity for illuminating the surface(s) of the object as a function of the fluorescent signal intensity measurements and the power constraints of the blue UV light source(s), and adjust the intensity of the blue UV light source(s) to attain fluorescence at the surface(s) that results in a detected fluorescent signal intensity that conforms with the ascertained appropriate fluorescent signal intensity.

The illumination systems of the various embodiments can also be configured with a user input component that can receive user input that facilitates user interaction with the control module for controlling the operation of the visible light source(s), the blue UV light source(s), and the sensor(s). In one embodiment, the blue UV light source(s) and/or the visible light source(s) can be activated by the user input component in response to receiving user input indicating a desire to utilize one or both of the sources.

The user input component can also be configured to receive user input pertaining to one of a plurality of illumination parameters. The illumination parameters can include, but are not limited to, the intensity of the visible light source(s), the intensity of the blue UV light source(s), a total intensity of the visible light source(s) and the blue UV light source(s), the spectral power distribution of the visible light source(s), the spectral power distribution of the blue UV light source(s), a ratio of illumination of the visible light source(s) to illumination of the blue UV light source(s), a direction of illumination of the visible light source(s), a spatial coverage of the sources, a direction of illumination of the blue UV light source(s), and a duration setting of the illumination by the blue UV light source(s). In one embodiment, the user input component can be used adjust the operation of at least one of the visible light sources or the blue UV light sources in response to receiving user input expressing a desire to perform such a function. For example, the user could input a specific yaw and/or pitch setting for the sources.

The illumination systems of the various embodiments can also use other mechanisms to improve the illumination of objects. For example, at least one additional source can be utilized to operate in conjunction with the visible light source(s) and the blue UV light source(s). In one embodiment, at least one of an infrared light source, a microwave source or an ultrasound source can be used to provide further illumination of a surface of an object. To this extent, sensors relating to the detection of such corresponding sources can be deployed, such as for example, an infrared detector, a microwave detector or an ultrasound detector.

A multiple of other components can be used with the various illumination systems. For example, a timer can be utilized to ensure that the blue UV light source(s) and visible light source(s) deliver a sufficient dosage of radiation to obtain a desired effect over a specified illumination time. In one embodiment, an output component that can include, but is not limited to, a visual display can provide status information on the illumination system. For example, the output component can indicate status information of the illumination (e.g., system is on or off, visibility could be improved with the activation of certain sources, etc.), as well as generate information on more specific details of the illumination. A power supply component can power the blue UV light source(s), the visible light source(s), the control module, the sensor(s), the user input component, the output component and the timer. The power supply component can include one of a number of different power sources.

A first aspect of the invention provides a system, comprising: a visible light source to emit visible light at a first intensity; a blue UV light source to emit blue UV light at a second intensity, the blue UV light stimulating fluorescence from at least one surface illuminated by the blue UV light; at least one sensor to detect a fluorescent signal intensity of the fluorescence from the at least one surface illuminated by the blue UV light source; and a control module operatively coupled to the visible light source, the blue UV light source, and the at least one sensor, wherein the control module is configured to change the intensity of the visible light emitted from the visible light source and/or the intensity of the blue UV light emitted from the blue UV light source as a function of the fluorescent signal intensity detected by the at least one sensor.

A second aspect of the invention provides an illumination system, comprising: a visible light emitting source to emit an intensity of visible light; a blue UV light emitting source to emit an intensity of blue UV light in a wavelength ranging from 340 nm to 460 nm; a fluorescent sensor configured to detect fluorescence emitted from a surface of an object irradiated by the blue UV light source; a control module operatively coupled to the visible light emitting source and the blue UV light emitting source, the control module configured to change the intensity of the visible light emitted from the visible light emitting source and/or the intensity of the blue UV light emitted from the blue UV light emitting source as a function of time and/or an intensity of fluorescence detected by the fluorescent sensor; and a user input component that allows a user to interact with the control module for controlling operation of the visible light emitting source and the blue UV light emitting source.

A third aspect of the invention provides a lighting system for a vehicle, comprising: a set of visible light emitting sources operational as part of a headlamp system of the vehicle, the set of visible light emitting sources configured to generate a set of beams of visible light; a set of blue UV light emitting sources located about the set of visible light emitting sources, wherein the set of blue UV light emitting sources is configured to generate a set of beams of blue UV light that is non-collinear to the set of beams of visible light, the set of blue UV light emitting sources configured with several yaw and pitch degrees of freedom in order to illuminate surfaces oriented at various angles with respect to a traveling direction of the vehicle; at least one sensor to detect fluorescence emitted from at least one surface illuminated by the set of blue UV light emitting sources; a control module operatively coupled to the set of visible light emitting sources, the set of blue UV light emitting sources, and the at least one sensor, wherein the control module is configured to manage an operation of the set of visible light emitting sources, the set of blue UV light emitting sources, and the at least one sensor; and a user input component configured to receive user input that facilitates user interaction with the control module for controlling the operation of the set of visible light emitting sources, the set of blue UV light emitting sources, and the at least one sensor.

BRIEF DESCRIPTION OF THE DRAWINGS

These and other features of the disclosure will be more readily understood from the following detailed description of the various aspects of the present invention taken in conjunction with the accompanying drawings that depict various aspects of the invention.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
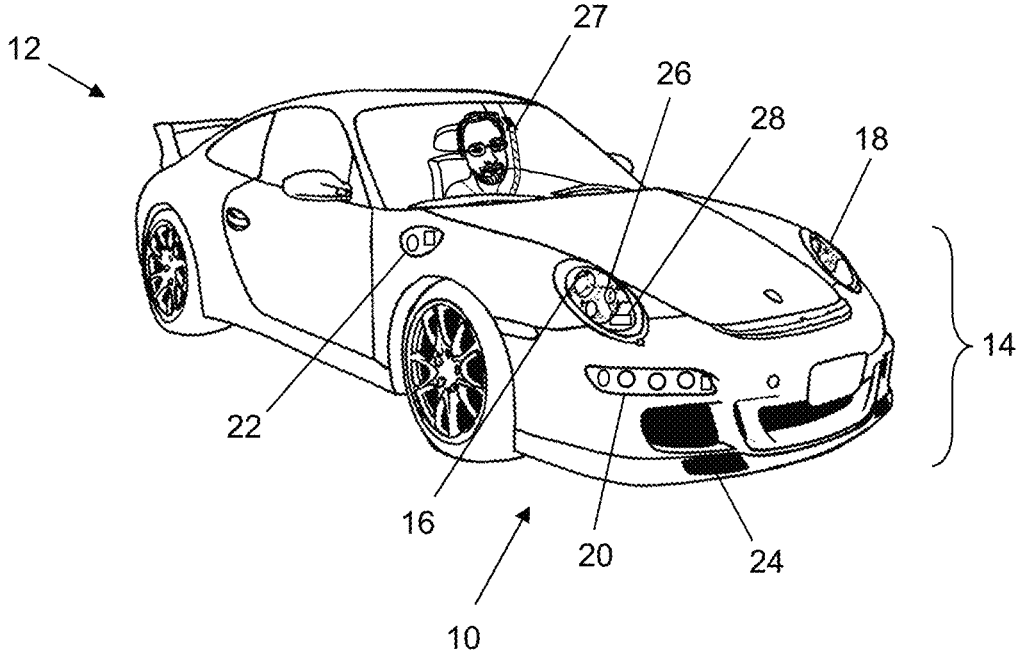
FIG. 1 shows a schematic of an illustrative illumination system for use in a lighting system of a vehicle such as a headlamp system according to an embodiment of the present invention.

As indicated above, aspects of the present invention are directed to illumination systems that utilize black light also referred to interchangeably as blue UV light with visible light to improve the illumination of objects. The illumination systems of the various embodiments are well suited for use with vehicles, and in particular, vehicle lighting systems such as vehicle headlamp systems. Use of the illumination system of any of the embodiments in a vehicle headlamp system can enhance nighttime visibility of objects and pedestrians in or near a road, making nighttime driving significantly safer for motorists in comparison to a headlamp system that relies only on low beams and high beams generating visible light to provide illumination.

The various embodiments of the present invention are described with respect to a lighting system in a car such as its headlamp system, however, it is understood that the various embodiments are applicable to lighting systems utilized in a wide variety of vehicles including, but not limited to, trucks, trains, planes, motorcycles, bicycles, and the like. Further, although the various embodiments are directed to vehicles, it is understood that the illumination systems described herein are suitable for use in other applications where illumination systems are used to provide visibility for a variety of reasons which can range from safety, security, aesthetic, enhanced vision, etc. Some examples where illumination systems of the various embodiments can be utilized include, but are not limited to, outdoor venues (e.g., stadiums, amphitheaters, etc.), street lighting, parking lots, video surveillance systems, and ornamental articles.

Those skilled in the art will appreciate that the illumination systems described herein can include any now known or later developed approach that incorporates the concepts of the various embodiments of the present invention. The illumination systems described herein can include a number of components (some of which may be optional). These components and the functions that each can perform are described below in more detail. The components can include any now known or later developed approaches that can facilitate implementation of the concepts and configurations of the various embodiments described herein.

Ultraviolet radiation, which can be used interchangeably with ultraviolet light, means electromagnetic radiation having a wavelength ranging from approximately 10 nanometers (nm) to approximately 400 nm. Within this range, there is ultraviolet-A (UV-A) electromagnetic radiation having a wavelength ranging from approximately 315 nm to approximately 400 nm, ultraviolet-B (UV-B) electromagnetic radiation having a wavelength ranging from approximately 280 nm to approximately 315 nm, and ultraviolet-C (UV-C) electromagnetic radiation having a wavelength ranging from approximately 100 nm to approximately 280 nm. As used herein, "blue UV light" means electromagnetic radiation or light having peak wavelength(s) located entirely within the UV-A range and/or the high wavelength range of the visible spectrum between 400 nm and 460 nm. To this extent, blue UV light can have peak wavelength(s) within the wavelength range of 315 nm to 460 nm. In a more specific embodiment, the blue UV light has peak wavelength(s) within a range of 340 nm to 460 nm.

As used herein, a material/structure is considered to be "reflective" to ultraviolet light of a particular wavelength when the material/structure has an ultraviolet reflection coefficient of at least 30 percent for the ultraviolet light of the particular wavelength. A highly ultraviolet reflective material/structure has an ultraviolet reflection coefficient of at least 80 percent. Furthermore, a material/structure/layer is considered to be "transparent" to ultraviolet radiation of a particular wavelength when the material/structure/layer allows at least ten percent of radiation having a target wavelength, which is radiated at a normal incidence to an interface of the material/structure/layer to pass there through.

The description that follows may use other terminology herein for the purpose of only describing particular embodiments and is not intended to be limiting of the disclosure. For example, unless otherwise noted, the term "set" means one or more (i.e., at least one) and the phrase "any solution" means any now known or later developed solution. The singular forms "a," "an," and "the" include the plural forms as well, unless the context clearly indicates otherwise. It is further understood that the terms "comprises," "comprising," "includes," "including," "has," "have," and "having" when used in this specification, specify the presence of stated features, integers, steps, operations, elements, and/or components, but do not preclude the presence or addition of one or more other features, integers, steps, operations, elements, components, and/or groups thereof. Additionally, spatially relative terms, such as "on," "below," "above," etc., may be used in reference to the orientation shown in the drawings. It is understood that embodiments of the invention are not limited to any particular orientation of a device described herein. Also, the use of a phrase of the form "at least one of A, B, C . . . or n" to delineate a listing of two or more possible parameters, components, characteristics, factors, etc., means any combination of one or more of A, B, C, . . . n. For example, at least one of A or B means only A, only B, or both A and B.

The description may also list values of parameters of elements, components, materials, layers, structures, and the like, for the purpose of describing further details of particular embodiments. It is understood that, unless otherwise specified, each value is approximate and each range of values included herein is inclusive of the end values defining the range. As used herein, unless otherwise noted, the term "approximately" is inclusive of values within +/−ten percent of the stated value, while the term "substantially" is inclusive of values within +/−five percent of the stated value. Unless otherwise stated, two values are "similar" when the smaller value is within +/−twenty-five percent of the larger value. A value, y, is on the order of a stated value, x, when the value y satisfies the formula $0.1x \leq y \leq 10x$. Unless otherwise stated, as used herein, parameters can have comparable values when the values of the corresponding parameters differ by at most ten percent (five percent in a more specific embodiment).

Figure 10:
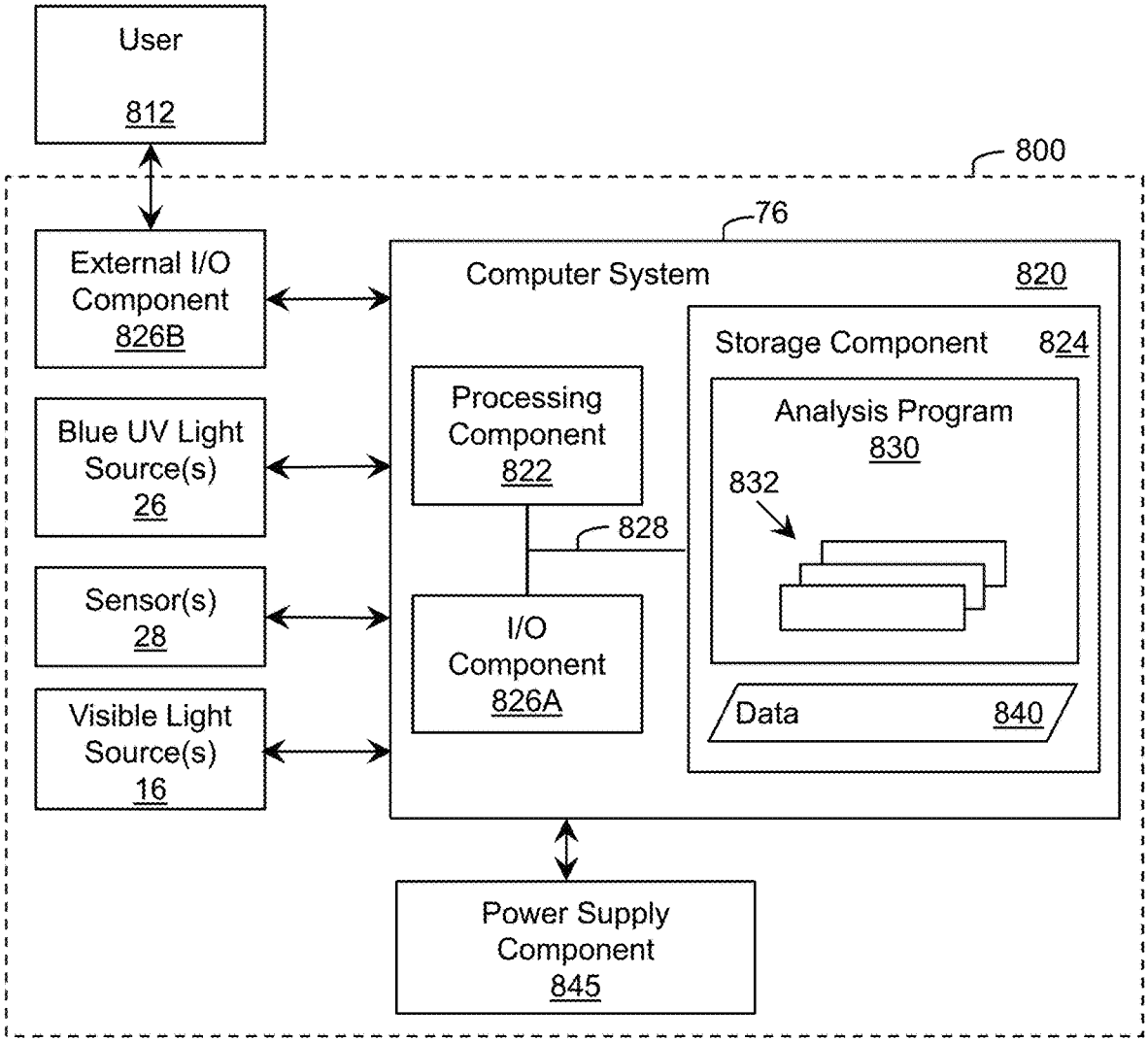
FIG. 10 shows a schematic block diagram representative of an overall processing architecture for an illumination system according to an embodiment of the present invention.

Turning to the drawings, FIG. 1 shows a schematic of an illustrative illumination system 10 for use in a lighting system of a vehicle 12 such as a car. In particular, the illumination system 10 can be integrated with a headlamp system 14 of the vehicle 12. As used herein the headlamp system 14 can include, but is not limited to, headlamps that operate to emit visible light with low beams and high beams (e.g., white light), front fog lights, and other light modalities used with a vehicle that are not limited to the front of the vehicle such as daytime running lights, direction indicators, side marking lights, spot lights, brake lights and hazard lights. For clarity, FIG. 1 only depicts components of the illumination system 10 that pertain to the light sources used to provide illumination of objects that one may encounter while traveling in the vehicle such as for example road signs, road markings, and other devices used to guide motorists, as well people or equipment that may be located about a road, and debris and animals that may be present about the road, and components used to detect the presence and enhance the visibility of such objects. Other components associated with the illumination system such as a control module, a user input component and an output component are depicted in FIG. 10. It is understood that the illumination system 10 of FIG. 1 only represents one possible configuration and is not meant to be limiting as other arrangements of such components depicted in this figure are possible.

The illumination system 10 of FIG. 1 as well as the other illumination systems described herein can include a visible light source 16 to emit visible light at a first intensity. The visible light source 16 can include a visible light emitting source that emits radiation having one or more peak wavelengths at least partially in a range of 400 nm to 700 nm. The visible light can comprise light with wavelengths across the visible spectrum and/or light having multiple distinct peak wavelengths in the visible spectrum such that the light is perceived as white light or a close variation thereof. Examples of a visible light emitting source can include, but are not limited to, a visible light emitting diode (LED), an incandescent light, a fluorescent light, a laser, a solid-state light source, a filament bulb, a xenon bulb, and/or the like. In one embodiment, the visible light source 16 can include a set of visible light sources configured to emit a set of visible light beams. For example, as shown in FIG. 1, the set of visible light sources can be deployed within the headlamp portion 18 of the vehicle 12, to function as low beams and high beams. In one embodiment, the set of visible light sources can include several peak wavelengths. The set of visible sources 16 can also be located about various other portions of the vehicle 12. For example, the set of visible sources 16 can be located in a front fog light section 20 of the vehicle 12, a side marking light section 22 and/or a spot light section 24 of the vehicle.

Each of the visible light sources 16 can be configured with several yaw and pitch degrees of freedom. In this manner, the illumination system 10 can provide a larger illumination coverage about the vehicle 12 at each yaw and pitch degree than what is typically provided with a conventional system that deploys visual light through low beams, high beams and other light modalities such as front fog lights, position lights, daytime running lights, direction indicators, side marking lights, brake lights and hazard lights. For example, in one embodiment, a visible light source with several degrees of yaw and pitch can be integrated within the side marking light section 22 of the vehicle to provide larger aerial illumination coverage. In one embodiment, the visible light sources 16 can be configured to execute small yaw and pitch oscillations to result in larger aerial coverage. In one embodiment, at least one visible light source 16 in the illumination system 10 can include a laser that generates a laser beam having a high frequency yaw and pitch motion that provides a larger illumination area than that provided by a conventional system. As used herein, a high frequency yaw and pitch motion means greater than or equal to 75 Hz, which is generally accepted as an appropriate scanning frequency to minimize flickering in visible perception. This is a standard value used for refresh rate in many traditional displays, such as LCD screens.

A blue UV light source 26 can supplement the visible light source(s) 16 by emitting blue UV light at a second intensity. For example, the blue UV light can include one or more peak wavelengths at least partially in a range of 340 nm to 460 nm. The blue UV light emitted from the blue UV light source 26, which can vary with time, can be used at the same time as the visible light source(s) 16. In operation, the blue UV light can stimulate fluorescence from at least one surface of an object (e.g., roads, road signs, road markings, other devices used to guide motorists, people, equipment located about the road, debris, animals, and components used to detect the presence and enhance the visibility of such objects (e.g., fluorescent clothing)). To this extent, the activation of the blue UV light source 26 along with the visible light source(s) 16 can further improve the visibility of a driver 27 of the vehicle 12 by providing enhanced illumination of objects and allowing the driver to visually identify objects through their fluorescence.

The blue UV light source 26 can include an ultraviolet light emitting source that emits blue UV light. Any combination of one or more ultraviolet radiation emitters can be used as a blue UV light emitting source. Examples of an ultraviolet radiation emitter include, but are not limited to, high intensity ultraviolet lamps (e.g., high intensity mercury lamps), discharge lamps, blue and/or UV LEDs, super luminescent LEDs, lasers, laser diodes, and/or the like. The blue UV light source 26 can also include a set of LEDs manufactured with one or more layers of materials selected from the group-III nitride material system (e.g., $Al_xIn_yGa_{1-x-y}N$, where $0 \leq x$, $y \leq 1$, and $x+y \leq 1$ and/or alloys thereof).

In one embodiment, the blue UV light source 26 can include a set of blue UV light sources operating at a set of peak wavelengths. In an embodiment, each of the blue UV light sources 26 within the set of blue UV light sources can be configured to operate at a different peak wavelength. The blue UV light sources 26 within the set of blue UV light sources can also differ by at least one of an intensity, an intensity distribution pattern, a spectral power distribution or size. Like the set of visible light sources, the set of blue UV light sources 26 or individual blue UV light sources in illumination systems with one blue UV light source can be configured with several yaw and pitch degrees of freedom in order to illuminate surfaces of objects oriented at various angles with respect to the blue UV light source(s) 26 and the visible light source(s) 16. For example, some blue UV light sources 26 can be deployed within the front fog light section 20 of the vehicle 12 to provide larger illumination coverage of objects that may be present in front of the vehicle in the near proximity to the vehicle as it travels over a road in nighttime hours. In one embodiment, at least one blue UV light source 26 in the illumination system 10 can include a laser that generates a laser beam having a high frequency yaw and pitch motion. In one embodiment, at least one blue UV light source 26 can be configured to execute small yaw and pitch oscillations to result in larger aerial coverage.

The visible light source(s) 16 and the blue UV light source(s) 26 can operate cooperatively with each other to generate beams of visible light and blue UV light, respectively, with different combinable features. For example, the visible light source(s) 16 can generate a focused beam of visible light having a first angular distribution and the blue UV light source(s) 26 can generate a diffuse beam of blue UV light having a second angular distribution. For instance, the visible illumination provided by the visible light source(s) 16 can function as long distance beams, and the blue UV illumination provided by the blue UV light source(s) 26 can function as low beams. The first angular distribution can differ from the second angular distribution so that the angle of illumination of each beam differs. This enables the visible light source(s) 16 to generate the focused beam and the blue UV light source(s) 26 to generate the diffuse beam, which allows identifying and observing objects that are not detected by visible radiation.

In one embodiment, the visible light source(s) 16 can generate a set of beams of visible light and the blue UV light source(s) 26 can generate a set of beams of blue UV light, wherein the set of beams of visible light and the set of beams of blue UV light are non-collinear in order to provide an overall larger area of illumination coverage. In one scenario, for a similar purpose, at least one beam of visible light from the set of beams of visible light can differ in direction from at least one beam of blue UV light from the set of beams of blue UV light by at least five degrees as measured from a beam peak intensity point. As used herein, a beam peak intensity point is defined as a location where the average light intensity of all light sources summed together is at a maximum intensity value compared to all other locations where light is or may be present, such as how most typical vehicle headlights have certain angles and points in front of the vehicle where the headlights are focused to provide maximum light intensity. In one embodiment, the visible light source(s) 16 and the blue UV light source(s) 26 can operate simultaneously such that each source emits light concurrently. In one embodiment, the intensity of visible light emitted from the visible light source(s) 16 at a target location can be comparable to the blue UV light emitted from the blue UV light source(s) 26 at that target location in order to attain an effect of the near light sources that is significant with regard to attaining visible fluorescence of objects.

The illumination system 10 of FIG. 1, as well any of the other illumination systems described herein can include at least one sensor 28 that is operatively coupled to the visible light source(s) 16 and the blue UV light source(s) 26 in order to obtain operational data relating to the illumination that is provided by the sources. The sensor(s) 28 can include any of a number of different sensors. For example, in one embodiment, a fluorescent sensor can be used to detect a fluorescent signal intensity of the fluorescence from at least one surface illuminated by the blue UV light source(s) 26. In one embodiment, a reflective sensor such as a visible light sensor can be used to detect visible light reflected from at least one surface illuminated by the visible light source in order to modulate the intensity of the light source, e.g., to maximize the visibility of the surface in question by adjusting the pitch and yaw of the light source to further improve the visibility.

In one embodiment, a plurality of environmental sensors can be used to detect one of a number of environmental conditions in which the visible light source(s) and the blue UV light source(s) operate. The vehicle 12 may experience a number of different conditions while it is operational on a road during any of the four seasons whether during the day or the night. For example, in the summer, the vehicle can experience conditions that can include, but are not limited to, humidity, temperature, smog and fog. Accordingly, sensors such as, but not limited to, a visible camera, a humidity sensor, a temperature sensor, a pressure sensor, a particle sensor, an ambient radiation sensor, a chemical sensor, etc., can be deployed with the illumination system 10. To this extent, these examples of sensors can be used to detect any of a number of environmental conditions such as humidity, temperature, clarity of air, a presence of fog, and a presence of air pollutants.

Figure 2:
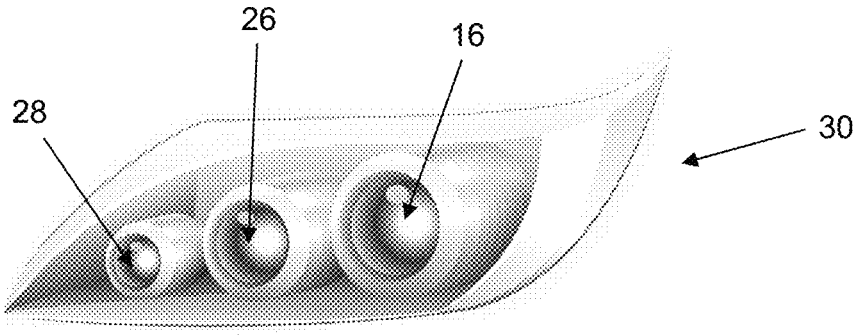
FIG. 2 shows a schematic of an illustrative illumination system for use with the headlamps of a vehicle having at least one visible light source, blue UV light source and a sensor according to an embodiment of the present invention.

The visible light source(s) 16, the blue UV light source(s) 26, and the sensor(s) 28 can be implemented within the headlamp system 14 of the vehicle 12 in a number of different arrangements. For example, FIG. 2 shows a schematic of an illustrative arrangement in which a visible light source 16, a blue UV light source 26, and a sensor 28 are positioned within one of the lighting sections of the headlamp system to form an illustrative illumination system 30. The particular lighting section of the headlamp system in which the arrangement depicted in FIG. 2 can be implemented is not meant to be limited to any one section, but instead can be deployed in one or more of a number of different lighting sections. For example, the illumination system 30 can be deployed in the headlamp portion 18 of the vehicle 12 as illustrated in FIG. 1, as well as but not limited to, the front fog light section 20, the side marking light section 22 and/or the spot light section 24. Further, it is understood that the number of sources 16, 26 and sensors 28 depicted in the illumination system 30 of FIG. 2 is not meant to be limiting, as those skilled in the art will appreciate that any number of different sources and sensors can be utilized in a number of different configurations.

Figure 3:
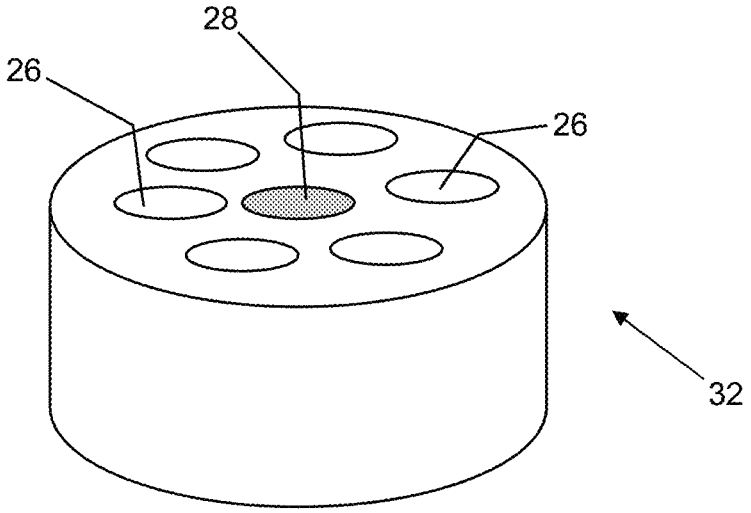
FIG. 3 shows a schematic of an illustrative illumination system having an array of blue UV LEDs operating in conjunction with a sensor according to an embodiment of the present invention.

FIG. 3 shows a schematic of an array of blue UV light sources 26 positioned about a sensor 28 that can be positioned within one of the lighting sections of the headlamp system of a vehicle to form an illustrative illumination system 32. This array of blue UV light sources 26 positioned about the sensor 28 can be deployed in one or more of a number of different lighting sections depicted with the vehicle 12 shown in FIG. 1, including but not limited to, the headlamp portion 18, the front fog light section 20, the side marking light section 22 and/or the spot light section 24 For example, the illumination system 32 can be deployed in the headlamp portion 18 of the vehicle 12 as illustrated in FIG. 1.

The array of blue UV light sources 26 can include an array of blue UV LEDs that emit blue UV light, while the sensor 28 can include a fluorescent sensor that can detect fluorescence emitted from surfaces of objects irradiated by the blue UV light. In one embodiment, the blue UV light generated from each blue UV LED can have a different peak wavelength that can elicit a different fluorescent response from certain objects. The blue UV LEDs that generate the blue UV light in the array of FIG. 3 can differ by at least one of intensity, an intensity distribution pattern, a spectral power distribution or size. Having the blue UV LEDs differ by one or more of these attributes is beneficial in that it allows for flexibility in the control system for the light sources depending on certain conditions present while operating the light sources. For example, in some instances, having a wide-angle distribution may be beneficial in optimal weather conditions, but may be detrimental in heavy fog where it could actually reduce visibility due to light reflection on the fog itself. In this case, a very tight angular distribution, along with pitch and yaw adjustment, could allow more focused illumination of specific surfaces while maintaining as close to optimal lighting conditions otherwise while still providing the benefit of the blue UV light source.

It is understood that the power supply to any of the blue UV LEDs can be changed to attain a desired intensity of blue UV light from the array that has a particular pattern and spectral distribution appropriate for illumination of objects in the environment in which the vehicle is likely to be traveling in. Changing the intensity and spectral distribution of the blue UV light can be effectuated through a control module and a user input component which are discussed below in more detail. In general, selecting the intensity and spectral power distribution of the blue UV light that is emitted from the array in FIG. 3 will depend on any of the aforementioned environmental conditions (e.g., humidity, temperature, clarity of the air, presence of fog, and presence of air pollutants).

The visible light source(s) 16 and the blue UV light source(s) 26 along with the sensor(s) 28 can be housed within an optical element. To this extent, the optical element can control a direction that the visible light is emitted from the visible light source(s) and a direction that the blue UV light is emitted from the blue UV light source(s). In particular, the optical element can collect as much as possible of the luminous flux (quantity of light) emitted by the visible light source(s) and the blue UV light source(s) to shape the respective beams of light and to direct the light to where it is needed, while the sensor(s) can detect fluorescence, reflected light, and/or one of aforementioned environmental conditions. For example, an optical element can be implemented with any of the lighting sections of the headlamp system 14 depicted with the vehicle 12 illustrated in FIG. 1 to ensure that the beams of light are directed to road-space areas in a manner that is within the bounds defined by legal regulations.

Figure 4:
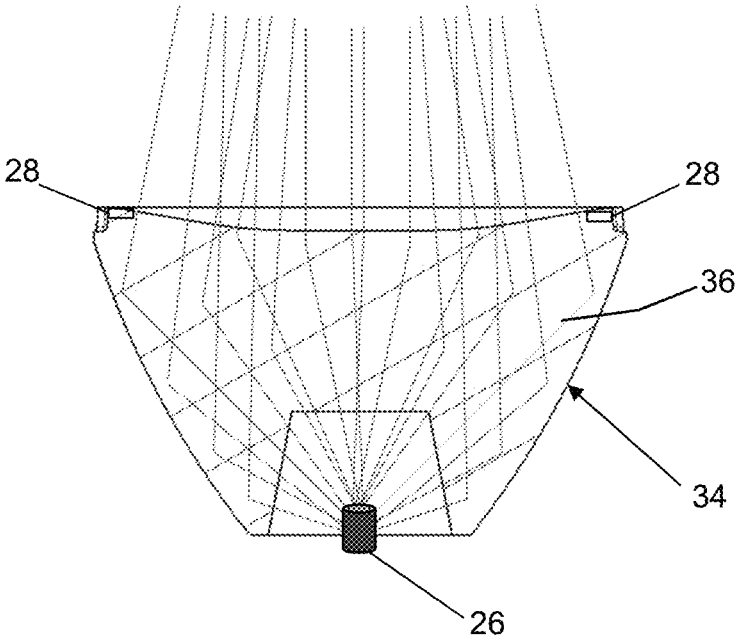
FIG. 4 shows a schematic of an illustrative optical element that can house a visible light source and/or a blue UV light source according to an embodiment of the present invention.

FIG. 4 shows a schematic of an illustrative optical element 34 housing a blue UV light source 26 and a pair of sensors 28 according to an embodiment of the present invention. Although FIG. 4 only shows a blue UV light source 26 and sensors 28 integrated with the optical element 34, it is understood that at least one visible light source 16 could be housed within the optical element in addition to the blue UV light source and the sensors, or located in its own optical element housing separate from the one containing the blue UV light source(s) 26 and sensors 28. In either scenario, the optical element 34 can be used to control a direction that the visible light is emitted from at least one visible light source 16 and a direction that the blue UV light is emitted from at least one blue UV light source 26.

In one embodiment, the optical element 34 can include a total internal reflection (TIR) lens having UV transparent media that can focus blue UV light emitted by the blue UV light source 26 into a collimated beam of light 36 as shown in FIG. 4. The UV transparent media can comprise at least one of $SiO_2$, $CaF_2$, $MgF_2$, or a fluoropolymer. Examples of a fluoropolymer that are suitable for use as a UV transparent media can include, but are not limited to, fluorinated ethylene-propylene (EFEP), fluorinated ethylene propylene (FEP), perfluoroalkoxy (PFA), tetrafluoroethylene hexafluoropropylene vinylidene fluoride (THV), polytetrafluoroethylene (PTFE), polyvinylidene fluoride (PVDF), ethylene-tetrafluoroethylene (ETFE), ethylene chlorotrifluoroethylene (ECTFE), polychlorotrifluoroethene (PCTFE), a copolymer of tetrafluoroethylene and perfluoro methyl alkoxy (MFA), low density polyethylene (LDPE), perfluoroether (PFA), and/or the like.

It is understood that other optical elements besides a TIR lens can be used to allow further manipulation (focusing) of the emitted radiation from either the visible light source(s) 16 and the blue UV light source(s) 26. Besides additional lenses, other optical elements that can be used to focus the emitted radiation can include, but are not limited to, a paraboloid reflector, and projector-type systems.

Figure 5:
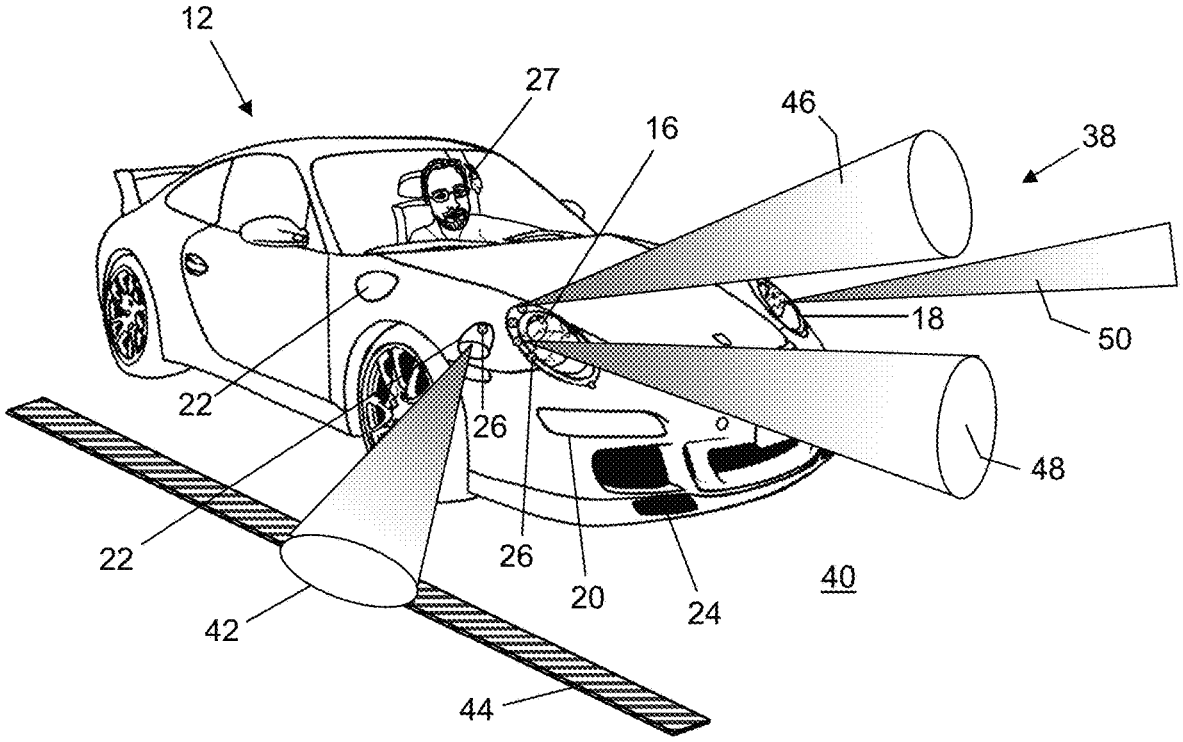
FIG. 5 shows a schematic of an illustrative illumination system for use in a lighting system of a vehicle with light sources configured to have several yaw and pitch degrees of freedom to provide larger illumination coverage about the vehicle according to an embodiment of the present invention.

As noted above, the visible light source(s) 16 and/or the blue UV light source(s) 26 can be configured with several yaw and pitch degrees of freedom in order to provide larger illumination coverage about a vehicle. FIG. 5 shows a schematic of an illustrative illumination system 38 for use in a lighting system of a vehicle 12 with light sources configured to have several yaw and pitch degrees of freedom. As shown in FIG. 5, the yaw and pitch degrees of freedom associated with the visible light source(s) 16 and/or the blue UV light source(s) 26 at the various lighting sections of the vehicle (e.g., the front fog light section 20, the side marking light section 22, and the spot light section 24) enable the illumination system 38 to illuminate surfaces of objects oriented at various angles with respect to the vehicle 12, and in particular, with respect to the blue UV light source(s) 26 and the visible light source(s) 16 located about the vehicle while traveling on a road 40. In FIG. 5, the visible light source(s) 16 and/or the blue UV light source(s) 26 located in the side marking light sections 22 of the vehicle can be configured to have several yaw and pitch degrees of freedom. In one embodiment, one of the side marking light sections 22 can include a blue UV light source 26 with several yaw and pitch degrees of freedom to generate a beam of light 42 that illuminates fluorescent road markings 44 overlaid on the road 40.

FIG. 5 also shows that the visible light source(s) 16 and/or the blue UV light source(s) 26 located in the headlamp portion 18 of the vehicle 12 can be configured with several yaw and pitch degrees of freedom. In one embodiment, the set of blue UV light sources 26 in the headlamp portion 18 of the vehicle 12 can generate a beam of light 46 that illuminates fluorescent signs that can overhang the road 40 and beam of light 48 that can illuminate fluorescent signs that are located off to the side of the road. The visible light source 16 in the headlamp portion 18 of the vehicle 12 with several yaw and pitch degrees of freedom can be used to generate a beam of light 50 that provides a different illumination angle than that typically provided with conventional low beams and high beams. Having the visible light source(s) 16 and the blue UV light sources 26 with several yaw and pitch degrees of freedom allows the driver 27 and/or the illumination system 38 of the vehicle 12 to customize the illumination provided by the illumination system 38 to match the conditions of the road 40 and the current environmental conditions about the vehicle.

It is understood that the embodiment depicted in FIG. 5 is only representative of one particular arrangement in which the lighting system of a vehicle can be configured with visible light sources 16 and blue UV light sources 26 that have several yaw and pitch degrees of freedom and is not meant to be exhaustive of all the possible positions and configurations. The design and placement of the sources with several yaw and pitch degrees of freedom along a vehicle can depend on a number of different factors such as the type of vehicle, the roads traveled, the type of objects that one would expect to encounter, etc. For example, the fog light section 20 of the vehicle 12 can be configured with one or more blue UV light sources 26 that have several yaw and pitch degrees of freedom to illuminate portions of the road 40 that are in the proximity of the vehicle in order to provide greater visibility of unexpected objects that may be found in the road, including hazards that form in the road such as potholes.

As noted above, the illumination systems of the various embodiments, such as those previously described with respect to FIGS. 1-5, as well those described below with respect to FIGS. 6-9, can utilize a control module that can be operatively coupled to the visible light source(s) 16, the blue UV light source(s) 26, and the sensor(s) 28 in order to manage an operation of these components. Managing the operation of the visible light source(s) 16, the blue UV light source(s) 26, and the sensor(s) 28 by way of the control module, which is schematically represented in the overall processing architectural diagram of FIG. 10, can entail a number of different control configurations. For example, a scenario in which a fluorescent sensor is deployed to measure fluorescence, the control module can change the intensity of the visible light emitted from the visible light source(s) 16 and/or the intensity of the blue UV light emitted from the blue UV light source(s) 26 as a function of the fluorescent signal intensity detected by the fluorescent sensor. In one embodiment, the control module can change at least one of the intensity, direction, or beam distribution of the visible light source(s) 16 and/or the blue UV light source(s) 26 based on feedback obtained from the fluorescent sensor.

In a scenario in which environmental sensors are deployed, the control module can be used to adjust the intensity of the blue UV light from the blue UV light source(s) 26 as a function of the environmental conditions detected by the plurality of environmental sensors. The control module can also direct the blue UV light source(s) 26 to emit the blue UV light with one of a predetermined pattern or a predetermined spectral distribution based on the environmental conditions. The control module can adjust the intensity of the light as a function of at least one of the operating parameters associated with the visible light source(s) 16 and the blue UV light source(s) 26 during illumination of the sources.

In one embodiment, the control module can evaluate an optimality of illumination provided by the visible light source(s) 16 and the blue UV light source(s) 26 as a function of detected fluorescent signal intensity. As used herein, an optimality of illumination means a condition where the most situational awareness can be provided from the light sources, such as where previously discussed, light sources can be modulated, focused, and/or directed, where environmental conditions dictate. In the previous example given, changing weather conditions from ideal to poor (such as entering heavy fog) would require light sources to be adjusted (such as from wide angle to tight angular distributions) to account for the environment to provide as much information possible for the viewing destination (as in a driver or video surveillance system).

In a related operation, the control module can optimize the illumination of at least one surface with the blue UV light source(s) 26 as a function of the detected fluorescent intensity. For example, the control module can determine a suitable peak wavelength for operating the blue UV light source(s) 26 by taking into account power constraints (e.g., heat output and current threshold) of operating the blue UV light source(s). In one embodiment, the control module can obtain a plurality of fluorescent signal intensity measurements from the at least one surface over a set of peak wavelengths, compare each of the fluorescent signal intensity measurements, ascertain an appropriate fluorescent signal intensity for illuminating the at least one surface as a function of the fluorescent signal intensity measurements and the power constraints of the blue UV light source(s) 26, and adjust the intensity of the blue UV light source(s) to attain fluorescence at the at least one surface that results in a detected fluorescent signal intensity that conforms with the ascertained appropriate fluorescent signal intensity.

In order to perform some of the aforementioned functions, the control module can be configured with additional components that facilitate these actions. For example, the control module can include a wireless transmitter and receiver that is configured to communicate with a remote location via Wi-Fi, BLUETOOTH, and/or the like. As used herein, a remote location is a location that is apart from an illumination system. For example, a remote computer can be used to transmit operational instructions to the wireless transmitter and receiver. The operational instructions can be used to program functions performed and managed by the control module. In another embodiment, the wireless transmitter and receiver can transmit output results, data from sensors to the remote computer to attain an analysis of the operability of the illumination system with regard to usage, its ability to perform its intended functions, and maintenance items that are necessary or impending. The control module can also include a storage device capable of storing all of the data that is obtained during the use of the illumination system. This capability enables the control module to statistically process the data, such as the history of the ultraviolet radiation intensity and duration, as well as the spectral power distribution of the ultraviolet radiation during the usages. It is understood that the control module can perform a multitude of other analyses of the data as desired.

The illumination systems of the various embodiments can also be configured with a user input component that can receive user input that facilitates user interaction with the control module for controlling the operation of the visible light source(s) 16, the blue UV light source(s) 26, and the sensor(s) 28. In one embodiment, the user input component can be positioned about the driving console within the vehicle 12. In this manner, the blue UV light source(s) 26 and/or the visible light source(s) 16 can be activated by the user input component in response to receiving user input indicating a desire to utilize one or both of the sources.

The user input component can also be configured to receive user input pertaining to one of a plurality of illumination parameters. The illumination parameters can include the intensity of the visible light source(s) 16, the intensity of the blue UV light source(s) 26, a total intensity of the visible light source(s) and the blue UV light source(s), the spectral power distribution of the visible light source(s), the spectral power distribution of the blue UV light source(s), a ratio of illumination of the visible light source(s) to illumination of the blue UV light source(s), and a direction of illumination of the visible light source(s), a spatial coverage of the sources, a direction of illumination of the blue UV light source(s) and a duration setting of the illumination by the blue UV light source(s). In one embodiment, the user input component can be used to adjust the operation of at least one of the visible light source(s) 16 or the blue UV light source(s) 26 in response to receiving user input expressing a desire to perform such a function. For example, the user could input a specific yaw and/or pitch setting for the sources.

The illumination systems of the various embodiments can use other mechanisms to improve the illumination of objects about a vehicle or within the environment that the vehicle operates. For example, at least one additional source can be utilized to operate in conjunction with the visible light source(s) 16 and the blue UV light source(s) 26. In one embodiment, at least one of an infrared light source, a microwave source or an ultrasound source can be used to provide further illumination so that the objects can be identified and located within a road. To this extent, sensors relating to the detection of such corresponding sources can be deployed, such as for example, an infrared detector, a microwave detector or an ultrasound detector. In one embodiment, an illumination system can use an infrared detector to convert infrared information obtained from surfaces of objects that are irradiated with infrared light into visible information. In another embodiment, an illumination system for a vehicle can use an ultrasound source and ultrasound detector (e.g., an ultrasound transmitter/receiver) to detect objects about the vehicle. In one embodiment, an infrared camera can be used to identify people and animals about a vehicle. It is understood that in order to properly utilize the infrared and ultrasound sources, the vehicle windshield can be equipped with an appropriate screen device to protect the sources from direct sunlight when operating the vehicle during times of daylight.

A multiple of other components can be used with the various illumination systems described herein. For example, a timer can be utilized to ensure that the blue UV light source(s) 16 and visible light source(s) 26 deliver a sufficient dosage of radiation to obtain a desired effect over a specified illumination time. In one embodiment, an output component that can operate in conjunction with the user input component, can include, but is not limited to, a visual display that can provide status information on the illumination. For example, the output component can indicate status information of the illumination system (e.g., the system is on or off, the visibility could be improved with the activation of certain sources, etc.), as well as generate information on more specific details of the illumination. A power supply component can power the blue UV light source(s) 26, the visible light source(s) 16, the control module, the sensor(s) 28, the user input component, the output component and the timer. The power supply component can include one of a number of different power sources. For example, the power supply component can include, but is not limited to, a rechargeable battery, one or more batteries, a vibration power generator that can generate power based on magnetic inducted oscillations or stresses developed on a piezoelectric crystal, and a super capacitor that is rechargeable.

Figure 6:
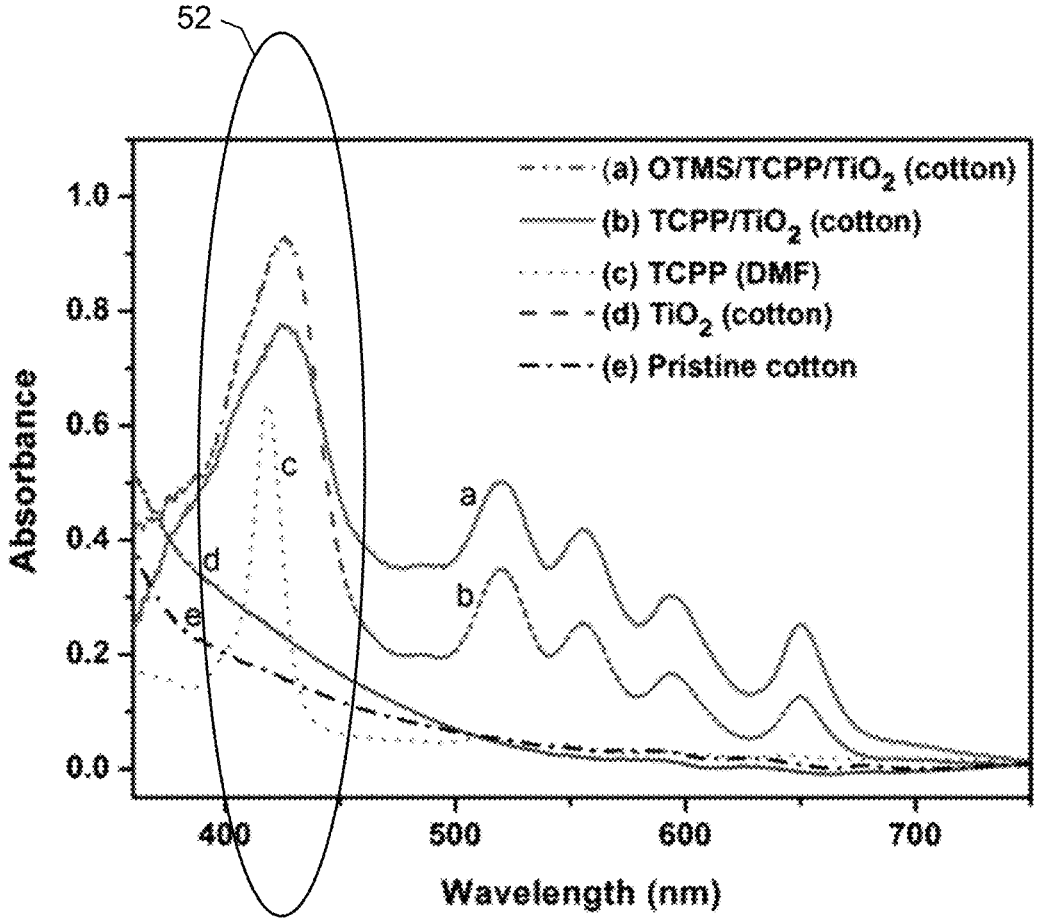
FIG. 6 shows an example of a plot of absorption for different materials over the electromagnetic radiation spectrum that can be used in the various embodiments to adjust a blue UV light source according to the fluorescence of objects that may be found with such materials near a road traveled by vehicles according to an embodiment of the present invention.

FIG. 6 shows an example of a plot of absorption for different materials over the electromagnetic radiation spectrum. In particular, FIG. 6 shows an example of absorption of different types of cotton over the radiation spectrum. More specifically, the plot of FIG. 6 highlights the absorption for the various types of cotton in the blue UV radiation range as noted by reference element 52. With the absorption of cotton known to have these types of characteristics as depicted in FIG. 6 for blue UV radiation, the control module of any of the illumination system described herein can be designed to tailor the spectral power distribution of the blue UV light source(s) 26. In particular, since cotton is a typical fabric used in most clothing, having the control module use a light source that maximizes UV fluorescence for cotton would cause this fabric to fluoresce more. The control system, having multiple UV wavelengths, can determine the best wavelength light to use given the feedback from UV sensors and which UV wavelength produced the maximum fluorescence detected by the sensor.

The control module with the various illumination systems described herein can utilize the plot of FIG. 6, as well as other plots for different materials that could be in objects that one would expect to encounter on or near the road, to tailor the spectral power distribution of the blue UV light source(s) 26. To this extent, the control module can use the tailored spectral power distribution to make adjustments to the intensity of the sources.

Figure 7:
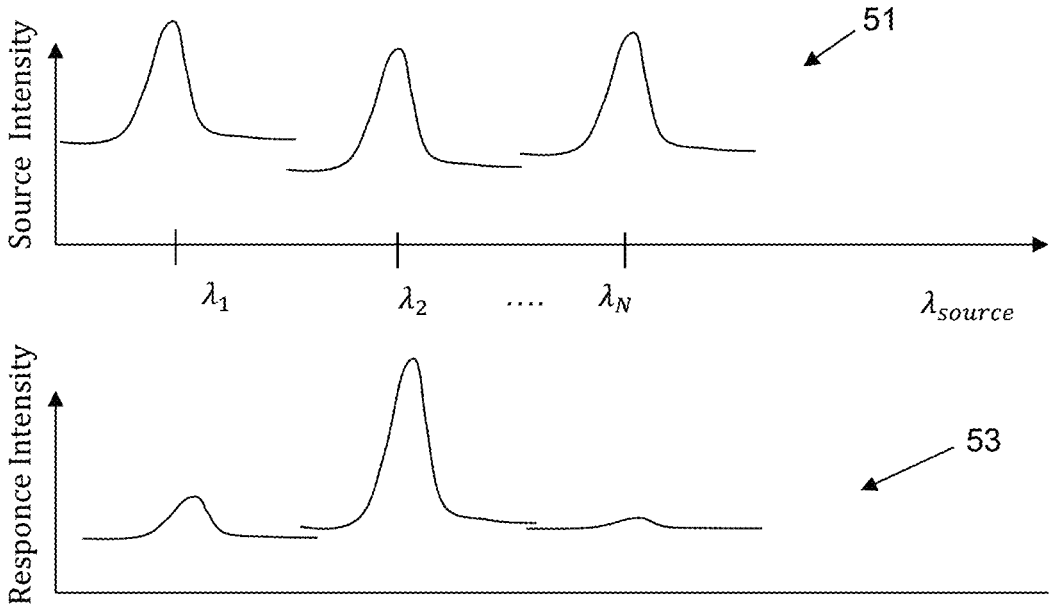
FIG. 7 shows one example of a graph representing a set of peak wavelengths associated with a blue UV light source and one example of a graph representing a detection of the intensities of the set of wavelengths by a sensor operating in conjunction with the blue UV light source, of which both graphs can be used by a control module to optimize the illumination by the blue UV light source according to an embodiment.

As mentioned previously, the control module can be configured to be used in an illumination system to evaluate the optimality of illumination provided by the visible light source(s) 16 and the blue UV light source(s) 28 as a function of the fluorescent signal intensity that is detected as objects are irradiated with blue UV light. As an example, consider the illumination system 32 depicted in FIG. 3 in which an array of blue UV LEDs 26 operate in conjunction with a sensor 28 such as a fluorescent sensor that can detect fluorescence emitted from objects irradiated by the blue UV light. FIG. 7 shows examples of a first graph 51 representing a set of peak wavelengths associated with the blue UV LEDs 26 in operation, and a second graph 53 representing a detection of the intensities of the fluorescent responses by the fluorescent sensor 28 for each of the peak wavelengths. In the first graph 51 of FIG. 7, the set of peak wavelengths generated from the array of blue UV LEDs 26 is represented by $\lambda_1$, $\lambda_2$ . . . $\lambda_N$, while the second graph 53 shows the fluorescent response intensity for each of the peak wavelengths that is detected by the fluorescent sensor 28. As shown in the second graph 53 of FIG. 7, the wavelength $\lambda_2$ evokes the largest fluorescent response intensity in comparison to the wavelength $\lambda_1$ which invokes a much smaller response intensity and wavelength $\lambda_N$ which has a negligible response.

With this type of information that is provided in the example of FIG. 7, the control module can optimize the operation of the blue UV LEDs 26 for improved illumination. That is, the control module can select the appropriate intensity of each blue UV LED 26 in the array for an optimal fluorescent response of each wavelength based on the fluorescent excitation of an object illuminated by the array as detected by the fluorescent sensor 28. For instance, in one scenario, the fluorescent response can be the largest when illuminated with a blue UV LED source having a wavelength) $\lambda_M$. Nevertheless, only a limited intensity of a single blue UV LED 26 in the array can be selected due to other limitations such as for example, heat management of the blue UV LEDs, the current thresholds of the blue UV LEDs, and/or the like. Thus, blue UV LEDs 26 having peak wavelengths different from $\lambda_M$ that still give a significant fluorescent response may have to be activated. Blue UV LEDs 26 that result in little or no fluorescent response for a particular object being illuminated do not have to be activated.

Figure 8:
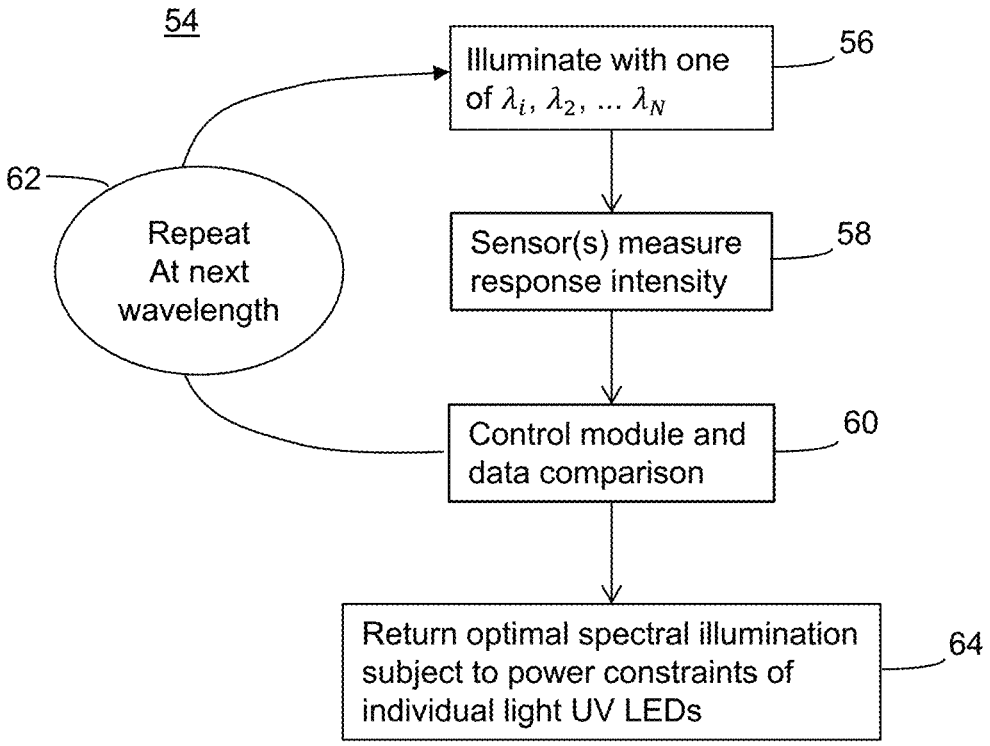
FIG. 8 shows an illustrative flow-chart describing actions associated with selecting a wavelength for optimal illumination with a blue UV light source according to an embodiment.

FIG. 8 shows an illustrative flow-chart 54 describing operations associated with illuminating an object with blue UV light, evaluating the fluorescent response intensity data, and iteratively selecting an appropriate wavelength for optimal illumination. As shown in FIG. 8, blue UV light source(s) 26 can illuminate an object with a set of peak wavelengths at action 56. In the iterative cycle depicted in FIG. 8, the evaluation starts with irradiating the object at a wavelength $\lambda_i$ and follows it with subsequent evaluation of other wavelengths in the set until the last wavelength in the set $\lambda_N$ is evaluated. For each wavelength, a fluorescent sensor(s) 28 can measure the fluorescent response intensity at action 58.

The control module receives the fluorescent response intensity data from the fluorescent sensor(s) 28 at action 60 and stores the data for subsequent evaluation. The iterative loop of the flow chart 54 is directed to action 62 where the object is illuminated with the next wavelength peak in the set. In this manner, actions 56-62 are repeated until the object has been irradiated at all peak wavelengths and fluorescent response intensity data has been attained at each wavelength. The control module can compare all of the fluorescent response intensity data at action 60 and determine a suitable peak wavelength at action 64 for operating the blue UV light source(s) 26 by taking into account power constraints (e.g., heat output and current threshold) of operating the blue UV light source(s). To this extent, the control module can direct the blue UV light source(s) 26 to operate at the appropriate wavelength that provides optimal illumination and control the operation of the source(s) 26 to conform to this wavelength making any necessary adjustments during the operation to stay within the prescribed values.

It is understood that the operations illustrated in FIG. 8 are illustrative of only one approach of selecting an appropriate wavelength for optimal illumination. For example, the operations could include more or less actions than that described. Also, it is understood that some of these actions can be performed in a different order than that described. In addition, it is understood that spectral selection actions depicted in FIG. 8 can be extended to the selection of peak wavelengths for visible light source(s) that include a plurality of peak wavelengths.

Figure 9:
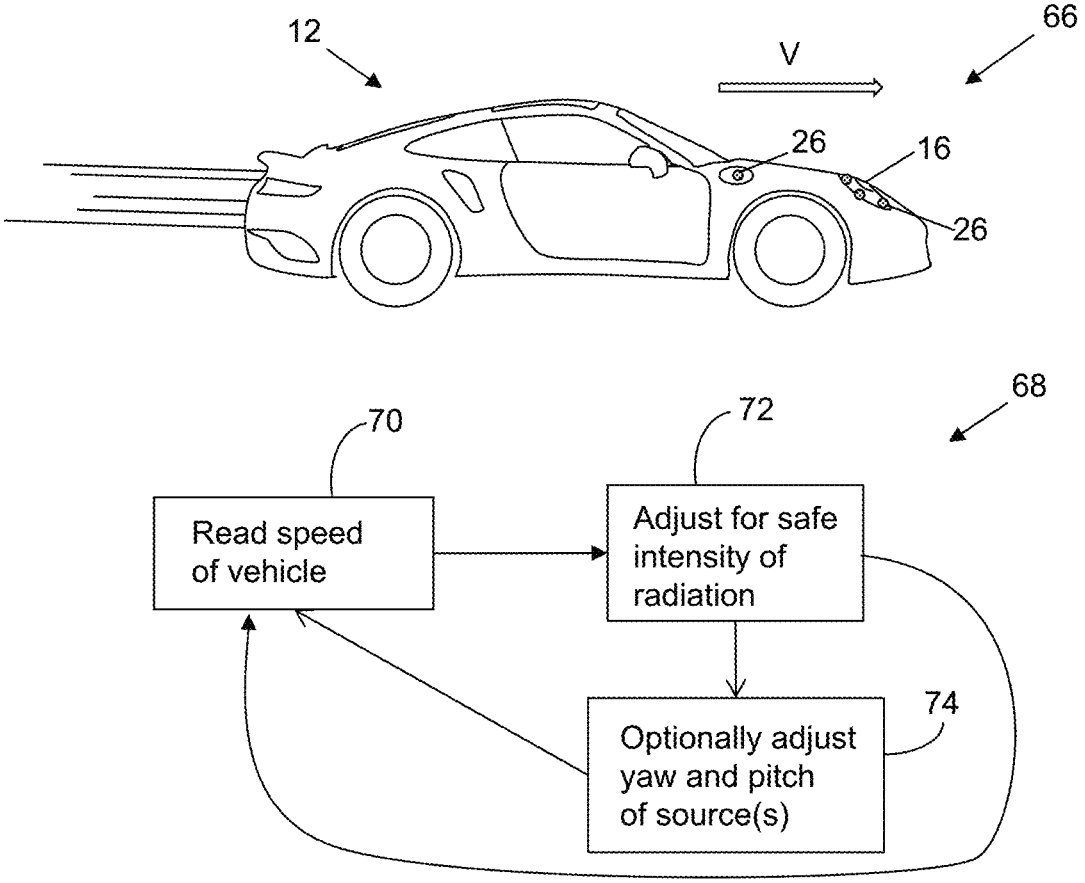
FIG. 9 shows an illustrative illumination system that can change the intensity of the visible light source(s) and the blue UV light source(s) as function of the speed of a vehicle, the environment about the vehicle and/or the position of any objects encountered by the vehicle while traveling according to an embodiment.

As noted above, the control module of the various embodiments can be used to adjust the intensities of the blue UV light source(s) 26 and/or the visible light source(s) 16 based on environmental conditions. For example, FIG. 9 shows an illustrative illumination system 66 that can change the intensity of the visible light source(s) 16 and the blue UV light source(s) 26 in a vehicle 12 as function of the speed of the vehicle, the environment about the vehicle and/or the position of any objects encountered by the vehicle while traveling. In the example depicted in FIG. 9, the control module within the illumination system 66 can monitor the speed of the vehicle 12 (as represented in the figure by the reference element V) according to an illustrative control loop 68.

As shown in FIG. 9, the control loop 68 includes reading the speed of the vehicle at action 70 and adjusting the intensity of the visible light source(s) 16 and/or the blue UV light source(s) 26 as a function of the speed at action 72. In general, it is desirable to ensure that the blue UV light source(s) 26 emit blue UV light at levels that are within predetermined safety emission levels prescribed for target objects that can include, but are not limited to, humans and animals. In one example, while the vehicle 12 is traveling in the nighttime on a local road where there may be a high incidence of running into people, the control module can be configured to adjust the intensity level of the blue UV light source(s) 26 to a predetermined level deemed safe for people when the speed of the car reduces down to a velocity that is associated with city or town driving (e.g., less than 35 miles per hour). This functionality is also applicable in a scenario when a car is traveling on a highway and slows down due to approaching an accident, a disabled vehicle, or the like. To this extent, the control module can adjust the intensity of the sources, such as the blue UV light source(s) 26 to a safe level or even shut the source(s) off. For cases in which the vehicle 12 is stationary, the control module can calculate acceptable UV-A dose levels over a target (e.g., a person, an animal, a sign, debris, etc.) and reduce the intensity of the blue UV light source(s) 26 to within the acceptable levels, or turn off the blue UV light sources when the dose levels reach the target values.

The control loop 68 of FIG. 9 also shows that in addition to adjusting the intensity of the source(s) to safe levels, the control module can optionally adjust the yaw and pitch of the blue UV light source(s) 26 and the visible light source(s) 16 at action 74. For example, in one scenario, the control module can adjust the yaw and pitch degrees of freedom of the blue UV light source(s) 26 and the visible light source(s) 16 to increase the coverage area of the illumination. In another scenario, the yaw and pitch of the blue UV light source(s) 26 and the visible light source(s) 16 can be adjusted independent of whether or not the intensity of the sources needs to be adjusted to a safe level. For example, the control module can adjust the yaw and pitch of the blue UV light source(s) 26 and the visible light source(s) 16 when it is determined that the vehicle 12 is traveling in the nighttime at higher speeds that are indicative of highway travel (e.g., 55 miles per hour or greater) in order to provide larger illumination coverage about the road. In this manner, the illumination system 66 can be used to provide greater illumination of the road to enhance the visibility of fluorescent type objects on the road such as signs, markers, and the like.

It is understood that the operations illustrated in FIG. 9 are illustrative of only one approach of adjusting the intensity of the blue UV light source(s) 26 and the visible light source(s) 16. For example, the operations could include more or less actions than that described. Also, it is understood that some of these actions can be performed in a different order than that described. In one embodiment, in addition to adjusting the intensity of the sources according to the speed of the vehicle, the control module can be configured to adjust the intensity of the sources according to the environment (e.g., the presence of fog, snow, etc.) and changes in the position of any illuminated objects. In one embodiment, the control module can be configured to change an intensity of the visible light emitting source(s) 16 and the blue UV light source(s) 26 as a function of changes in position of the sources. In one embodiment, the control module can be configured to adjust an intensity and duration of the blue UV light emitted from the blue UV light source(s) 26 to a predetermined acceptable safety level in response to a sensor 28 detecting a presence of a person or animal. In one embodiment, the control module can be configured to change an intensity of at least one of the visible light source(s) 16 or the set of blue UV light source(s) 26 in response to detecting an approaching vehicle.

FIG. 10 shows a schematic block diagram representative of an overall processing architecture 800 for an illumination system that is applicable to any of the embodiments described herein. In FIG. 10, the architecture 800 is shown including the blue ultraviolet light source(s) 26, visible light source(s) 16 and the sensor(s) 28 for the purposes of illustrating the interaction of all of the components that can be used to provide an illumination system.

As depicted in FIG. 10 and described herein, the processing architecture 800 can include a control module 76. In one embodiment, the control module 76 can be implemented as a computer system 820 including an analysis program 830, which makes the computer system 820 operable to manage the sources in the manner described herein. In particular, the analysis program 830 can enable the computer system 820 to operate the sources to generate and direct ultraviolet radiation and visible light and process data corresponding to one or more attributes regarding the irradiation, which can be acquired by the sensor(s) 28. The computer system 820 can control each source and sensor individually or as a group.

In an embodiment, during an initial period of operation, the computer system 820 can acquire data from at least one of the sensors regarding one or more attributes of the irradiation and generate data 840 for further processing. The data 840 can include information regarding an amount of radiation (e.g., ultraviolet, infrared, visible, ultrasound and/or microwave) detected, and/or the like. The computer system 820 can use the data 840 to control one or more aspects of the irradiation by the various sources.

Furthermore, one or more aspects of the operation of the sources can be controlled or adjusted by a user 812 via an external I/O component 826B. The external I/O component 826B can be used to allow the user 812 to selectively turn on/off the sources, etc.

The external I/O component 826B can include, for example, a touch screen that can selectively display user interface controls, such as control dials, which can enable the user 812 to adjust one or more of: an intensity, scheduling, and/or other operational properties of a set of sources (e.g., operating parameters, radiation characteristics). In an embodiment, the external I/O component 826B could conceivably include a keyboard, a plurality of buttons, a joystick-like control mechanism, and/or the like, which can enable the user 812 to control one or more aspects of the operation of the set of sources. The external I/O component 826B also can include any combination of various output devices (e.g., an LED, a visual display), which can be operated by the computer system 820 to provide status information pertaining to the illumination for use by the user 812. For example, the external I/O component 826B can include one or more LEDs for emitting a visual light for the user 812, e.g., to indicate a status of the illumination. In an embodiment, the external I/O component 826B can include a speaker for providing an alarm (e.g., an auditory signal), e.g., for signaling that ultraviolet radiation is being generated. In another embodiment, the user 812 can comprise a computer system, such as an onboard control system for the vehicle, and the external I/O component 826B can provide an interface that enables the computer system to adjust one or more of the operating parameters in an automated manner.

The computer system 820 is shown including a processing component 822 (e.g., one or more processors), a storage component 824 (e.g., a storage hierarchy), an input/output (I/O) component 826A (e.g., one or more I/O interfaces and/or devices), and a communications pathway 828. In general, the processing component 822 executes program code, such as the analysis program 830, which is at least partially fixed in the storage component 824. While executing program code, the processing component 822 can process data, which can result in reading and/or writing transformed data from/to the storage component 824 and/or the I/O component 826A for further processing. The pathway 828 provides a communications link between each of the components in the computer system 820. The I/O component 826A and/or the external interface I/O component 826B can comprise one or more human I/O devices, which enable a human user 812 to interact with the computer system 820 and/or one or more communications devices to enable a system user 812 to communicate with the computer system 820 using any type of communications link. To this extent, during execution by the computer system 820, the analysis program 830 can manage a set of interfaces (e.g., graphical user interface(s), application program interface, and/or the like) that enable human and/or system users 812 to interact with the analysis program 830. Furthermore, the analysis program 830 can manage (e.g., store, retrieve, create, manipulate, organize, present, etc.) the data, such as data 840, using any solution.

In any event, the computer system 820 can comprise one or more general purpose computing articles of manufacture (e.g., computing devices) capable of executing program code, such as the analysis program 830, installed thereon. As used herein, it is understood that "program code" means any collection of instructions, in any language, code or notation, that cause a computing device having an information processing capability to perform a particular function either directly or after any combination of the following: (a) conversion to another language, code or notation; (b) reproduction in a different material form; and/or (c) decompression. To this extent, the analysis program 830 can be embodied as any combination of system software and/or application software.

Furthermore, the analysis program 830 can be implemented using a set of modules 832. In this case, a module 832 can enable the computer system 820 to perform a set of tasks used by the analysis program 830, and can be separately developed and/or implemented apart from other portions of the analysis program 830. When the computer system 820 comprises multiple computing devices, each computing device can have only a portion of the analysis program 830 fixed thereon (e.g., one or more modules 832). However, it is understood that the computer system 820 and the analysis program 830 are only representative of various possible equivalent monitoring and/or control systems that may perform a process described herein with regard to the control module, the sources and the sensors. To this extent, in other embodiments, the functionality provided by the computer system 820 and the analysis program 830 can be at least partially implemented by one or more computing devices that include any combination of general and/or specific purpose hardware with or without program code. In each embodiment, the hardware and program code, if included, can be created using standard engineering and programming techniques, respectively. In another embodiment, the control module can be implemented without any computing device, e.g., using a closed loop circuit implementing a feedback control loop in which the outputs of one or more sensors are used as inputs to control the operation of the illumination system.

Regardless, when the computer system 820 includes multiple computing devices, the computing devices can communicate over any type of communications link. Furthermore, while performing a process described herein, the computer system 820 can communicate with one or more other computer systems using any type of communications link. In either case, the communications link can comprise any combination of various types of wired and/or wireless links; comprise any combination of one or more types of networks; and/or utilize any combination of various types of transmission techniques and protocols.

All of the components depicted in FIG. 10 can receive power from a power supply component 845. The power component 845 can take the form of one or more batteries, a vibration power generator that can generate power based on magnetic inducted oscillations or stresses developed on a piezoelectric crystal, an electrical interface for accessing electrical power supplied by the vehicle, and/or the like. In an embodiment, the power supply component 845 can include a super capacitor that is rechargeable. Other power supply components that are suitable for use as the power component can include solar, a mechanical energy to electrical energy converter such as a piezoelectric crystal, a rechargeable device, etc.

While shown and described herein as a device, a system and a method, it is understood that aspects of the present invention further provide various alternative embodiments. For example, in one embodiment, the various embodiments of the present invention can include a computer program fixed in at least one computer-readable medium, which when executed, enables a computer system to facilitate the illumination operation. To this extent, the computer-readable medium includes program code, such as the analysis program 830, which enables a computer system to implement some or all of a process described herein. It is understood that the term "computer-readable medium" comprises one or more of any type of tangible medium of expression, now known or later developed, from which a copy of the program code can be perceived, reproduced, or otherwise communicated by a computing device. For example, the computer-readable medium can comprise: one or more portable storage articles of manufacture; one or more memory/storage components of a computing device; and/or the like.

The foregoing description of the various aspects of the present invention has been presented for purposes of illustration and description. It is not intended to be exhaustive or to limit the various embodiments of the present invention to the precise form disclosed, and obviously, many modifications and variations are possible. Such modifications and variations that may be apparent to an individual in the art are considered to fall within the scope of the various embodiments of the present invention.

What is claimed is:

1. A system, comprising:

a visible light source to emit visible light at a first intensity;

a blue UV light source to emit blue UV light at a second intensity, the blue UV light stimulating fluorescence from at least one surface illuminated by the blue UV light;

at least one sensor to detect a fluorescent signal intensity of the fluorescence from the at least one surface illuminated by the blue UV light source; and a control module operatively coupled to the visible light source, the blue UV light source, and the at least one sensor, wherein the control module is configured to change the intensity of the visible light emitted from the visible light source and/or the intensity of the blue UV light emitted from the blue UV light source as a function of the fluorescent signal intensity detected by the at least one sensor.

2. The system of claim 1, wherein the blue UV light source comprises a plurality of blue UV light sources operating at a plurality of peak wavelengths.

3. The system of claim 2, wherein the at least one sensor comprises a fluorescent sensor to detect the fluorescent signal intensity of the fluorescence from the at least one surface illuminated by the plurality of blue UV light sources, wherein the control module is configured to adjust a relative intensity of the blue UV light emitted from each of the plurality of blue UV light sources as a function of the fluorescent signal intensity detected by the fluorescent sensor.

4. The system of claim 1, wherein the intensity of the blue UV light emitted from the blue UV light source varies with time.

5. The system of claim 1, wherein at least one of the visible light source or the blue UV light source comprises a laser configured to generate a laser beam having a high frequency yaw and pitch motion that provides a large illumination area.

6. The system of claim 1, further comprising an optical element to house the visible light source and the blue UV light source, wherein the optical element is configured to control a direction that the visible light is emitted from the visible light source and a direction that the blue UV light is emitted from the blue UV light source, wherein the optical element comprises a total internal reflection (TIR) lens having UV transparent media.

7. The system of claim 1, wherein the visible light source is configured to generate a focused beam of visible light and the blue UV light source is configured to generate a diffuse beam of blue UV light.

8. The system of claim 1, wherein the visible light source is configured to generate a set of beams of visible light and the blue UV light source is configured to generate a set of beams of blue UV light, wherein the set of beams of visible light and the set of beams of blue UV light are non-collinear.

9. The system of claim 8, wherein at least one beam of visible light from the set of beams of visible light differs in direction from at least one beam of blue UV light from the set of beams of blue UV light by at least five degrees as measured from a beam peak intensity point.

10. An illumination system, comprising:

a visible light emitting source to emit an intensity of visible light;

a blue UV light emitting source to emit an intensity of blue UV light in a wavelength ranging from 340 nm to 460 nm;

a fluorescent sensor configured to detect fluorescence emitted from a surface of an object irradiated by the blue UV light source;

a control module operatively coupled to the visible light emitting source and the blue UV light emitting source, the control module configured to change the intensity of the visible light emitted from the visible light emitting source and/or the intensity of the blue UV light emitted from the blue UV light emitting source as a function of time and/or an intensity of fluorescence detected by the fluorescent sensor; and a user input component that allows a user to interact with the control module for controlling operation of the visible light emitting source and the blue UV light emitting source.

11. The illumination system of claim 10, wherein the control module is configured to change at least one of the intensity, direction, or beam distribution of the visible light emitting source and/or the blue UV light emitting source based on feedback obtained from the fluorescent sensor.

12. The illumination system of claim 10, further comprising a reflective sensor configured to detect visible light reflected from a surface of the object illuminated by the visible light.

13. The illumination system of claim 10, further comprising a plurality of environmental sensors each configured to detect one of a plurality of environmental conditions in which the visible light emitting source and the blue UV light emitting source operate, the plurality of environmental conditions comprising: humidity, temperature, a clarity of air, a presence of fog, and a presence of air pollutants.

14. The illumination system of claim 10, wherein the control module is configured to evaluate an optimality of illumination provided by the visible light emitting source and the blue UV light emitting source, wherein the control module evaluates the optimality of illumination as a function the intensity of fluorescence detected by the fluorescent sensor.

15. The illumination system of claim 10, wherein the control module is configured to optimize the illumination of the object with the blue UV light emitting source as a function of the detected fluorescent intensity, wherein the control module determines a suitable peak wavelength for operating the blue UV light emitting source taking into account power constraints of operating the blue UV light emitting source, wherein the control module is configured to obtain a plurality of fluorescent intensity measurements from the surface of the object over a plurality of peak wavelengths, compare each of the fluorescent intensity measurements, ascertain an appropriate fluorescent intensity for illuminating the surface of the object as a function of the fluorescent intensity measurements and the power constraints of the blue UV light emitting source, and adjust the intensity of the blue UV light emitting source to attain fluorescence at the surface of the object that results in a detected fluorescent intensity that conforms with the ascertained appropriate fluorescent intensity.

16. The illumination system of claim 10, wherein the blue UV light emitting source is activated by the user input component in response to receiving user input indicating a desire to utilize the blue UV light emitting source, and wherein the control module is configured to adjust the operation of at least one of the visible light emitting source or the blue UV light emitting source in response to the user input received by the user input component.

17. A lighting system for a vehicle, comprising:

a set of visible light emitting sources operational as part of a headlamp system of the vehicle, the set of visible light emitting sources configured to generate a set of beams of visible light;

a set of blue UV light emitting sources located about the set of visible light emitting sources, wherein the set of blue UV light emitting sources is configured to generate a set of beams of blue UV light that is non-collinear to the set of beams of visible light, the set of blue UV light emitting sources configured with several yaw and pitch degrees of freedom in order to illuminate surfaces oriented at various angles with respect to a traveling direction of the vehicle;

at least one sensor to detect fluorescence emitted from at least one surface illuminated by the set of blue UV light emitting sources;

a control module operatively coupled to the set of visible light emitting sources, the set of blue UV light emitting sources, and the at least one sensor, wherein the control module is configured to manage operation of the set of visible light emitting sources, the set of blue UV light emitting sources, and the at least one sensor; and a user input component configured to receive user input that facilitates user interaction with the control module for controlling the operation of the set of visible light emitting sources, the set of blue UV light emitting sources, and the at least one sensor.

18. The lighting system of claim 17, wherein the control module is configured to change an intensity of the set of visible light emitting sources and/or the set of blue UV light emitting sources as a function of a speed of the vehicle.

19. The lighting system of claim 17, wherein the control module is configured to adjust an intensity and duration of the blue UV light emitted from the set of blue UV light emitting sources to within a predetermined acceptable safety level in response to detecting a person.

20. The lighting system of claim 17, wherein the control module is configured to change an intensity of at least one of the set of visible light emitting sources and/or the set of blue UV light emitting sources in response to detecting an approaching vehicle.

* * * * *